US011933117B2

(12) United States Patent
Hill et al.

(10) Patent No.: US 11,933,117 B2
(45) Date of Patent: Mar. 19, 2024

(54) TUBULAR COMPENSATION METHOD

(71) Applicant: Weatherford Technology Holdings, LLC, Houston, TX (US)

(72) Inventors: Troy F. Hill, Lafayette, LA (US); Jimmy L. Hollingsworth, Cypress, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

(21) Appl. No.: 16/894,554

(22) Filed: Jun. 5, 2020

(65) Prior Publication Data

US 2020/0318443 A1 Oct. 8, 2020

Related U.S. Application Data

(63) Continuation of application No. PCT/US2017/065119, filed on Dec. 7, 2017.

(51) Int. Cl.
*E21B 19/086* (2006.01)
*E21B 19/06* (2006.01)
*E21B 19/16* (2006.01)

(52) U.S. Cl.
CPC ..... *E21B 19/086* (2013.01); *E21B 19/06* (2013.01); *E21B 19/16* (2013.01)

(58) Field of Classification Search
CPC ..... E21B 19/16; E21B 19/086; E21B 19/09
See application file for complete search history.

(56) References Cited

U.S. PATENT DOCUMENTS

| | | | | |
|---|---|---|---|---|
| 3,912,227 | A | 10/1975 | Meeker et al. | |
| 4,867,418 | A | 9/1989 | Daniels | |
| 5,850,877 | A | 12/1998 | Albright et al. | |
| 6,000,472 | A * | 12/1999 | Albright | E21B 19/06 166/380 |
| 6,056,060 | A * | 5/2000 | Abrahamsen | E21B 19/02 166/380 |
| 2009/0065223 | A1* | 3/2009 | Bouligny, Jr. | E21B 19/16 173/1 |
| 2010/0200215 | A1* | 8/2010 | Juhasz | E21B 19/07 166/77.51 |
| 2014/0034329 | A1 | 2/2014 | Skinnes et al. | |
| 2017/0211343 | A1 | 7/2017 | Thiemann | |

FOREIGN PATENT DOCUMENTS

WO 99/34088 A1 7/1999

OTHER PUBLICATIONS

International Search Report and Written Opinion in related application PCT/US2017/065119 dated Aug. 10, 2018.

* cited by examiner

*Primary Examiner* — Theodore N Yao
(74) *Attorney, Agent, or Firm* — Smith IP Services, P.C.

(57) ABSTRACT

A tubular handling assembly includes an elevator and a tubular compensator assembly. The tubular compensator assembly includes a housing; a lift member coupled to the housing; a support member; and an actuator for moving the housing and the lift member relative to the support member and the elevator.

4 Claims, 6 Drawing Sheets

TUBULAR COMPENSATION METHOD

CROSS-REFERENCE TO RELATED APPLICATIONS

This application is a continuation of PCT International Application PCT/US2017/065119, filed Dec. 7, 2017, which application is incorporated herein by reference in its entirety.

BACKGROUND

Field

Embodiments of the present disclosure generally relate to a tubular compensator.

Description of the Related Art

In wellbore construction and completion operations, a wellbore is formed to access hydrocarbon-bearing formations (e.g., crude oil and/or natural gas) by drilling the formation. Drilling is accomplished by utilizing a drill bit that is mounted on the end of a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a section of casing is lowered into the wellbore. An annulus is thus formed between the string of casing and the formation. The casing string is hung from the wellhead. A cementing operation is then conducted in order to fill the annulus with cement. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

Drill strings and casing strings are typically assembled by screwing together threaded joints end to end. As the joints are screwed together, allowance must be made for longitudinal displacement of the couplings as one is rotated relative to the other. Such displacement is accounted for using a thread (aka joint) compensator. Several prior art compensators are not designed to support an entire string of joints and/or do not inhibit or prevent undesirable movement of such joints within a derrick, particularly unwanted movement of a top end of a stand of joints in a derrick.

One such system uses a compensator connected between a travelling block and a typical elevator. The upper end of the compensator is connected to the travelling block using a cable or cables. The lower end of the compensator is connected to the elevator using a cable or cables. If a stand of multiple joints is lifted with such a system, it is possible for the top of the stand to whip around in the derrick due to the freedom of movement permitted by the cable(s).

When a joint compensator is used to support only one joint, once the single joint has been moved in and connected to a string that hangs from the slips in the rotary table, the single joint compensator must be disconnected and moved out of the way, then a lifting elevator is connected to the string below the travelling block to support the entire string.

There is a need, therefore, for a compensator that is modular and can be used to support a single tubular or a string of tubulars.

SUMMARY

In one embodiment, a tubular compensator assembly includes a housing; a lift member coupled to the housing; a support member; and an actuator for moving the housing and the lift member relative to the support member.

In another embodiment, a tubular handling assembly includes an elevator and a tubular compensator assembly. The tubular compensator assembly includes a housing; a lift member coupled to the housing; a support member; and an actuator for moving the housing and the lift member relative to the support member and the elevator.

In another embodiment, a method of connecting a first tubular to a second tubular includes supporting the first tubular using a compensator; transferring a weight of the first tubular to an elevator; actuating the compensator to lift the first tubular relative to the elevator while maintaining the weight on the elevator; and rotating the first tubular relative to the second tubular for connection.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1:
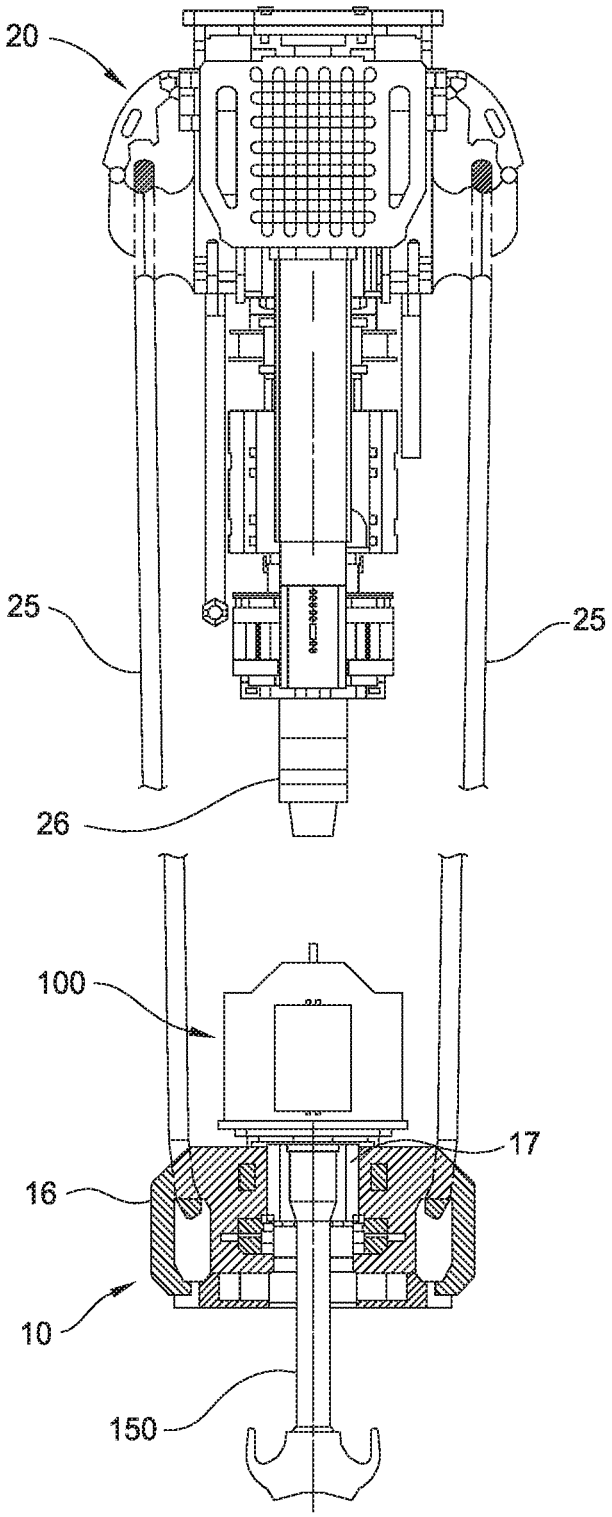
FIG. 1 illustrates an exemplary compensator assembly supported by an elevator, according embodiments of the disclosure.

FIG. 1 illustrates an exemplary compensator 100 supported by an elevator 10. The elevator 10 is connected to a top drive 20 using bails 25. The top drive 20 is supported in a rig (not shown). The top drive 20 includes a drive shaft 26 that can be connected to a tool.

In one example, the elevator 10 is a side door elevator. The elevator 10 includes two side doors hingedly attached to a body of the elevator 10. A latch is used to keep the side doors closed. A bore 17 is defined in the elevator 10 by the body and the two side doors. The side doors and the latch may be operated by one or more cylinder assemblies (not shown). The cylinder assemblies may be actuated using any suitable manner known, including electrics, mechanics, or fluids such as hydraulics and pneumatics. A pneumatic fluid sent to the elevator 10 may release the latch and open the side doors to receive a lift member 150 in the bore of the elevator. Specifically, the cylinder assemblies pivot the side doors outward to enable the lift member 150 to pass between the side doors and to be received in the bore 17 of the elevator 10. The elevator 10 is coupled to the bails 25 using two ears 16 disposed on each side of the elevator 10.

Figure 2:
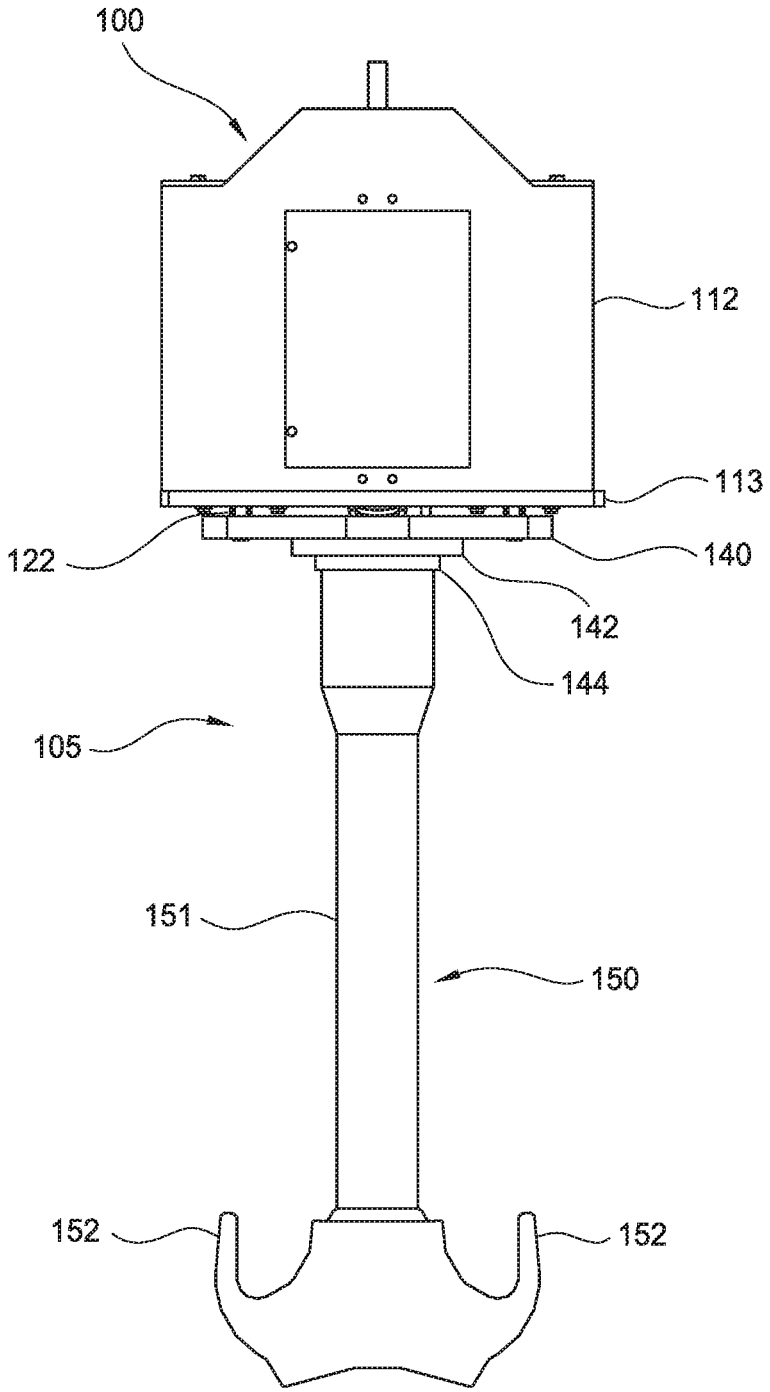
FIG. 2 illustrates a perspective view of the compensator assembly and the lift member.
Figure 3:
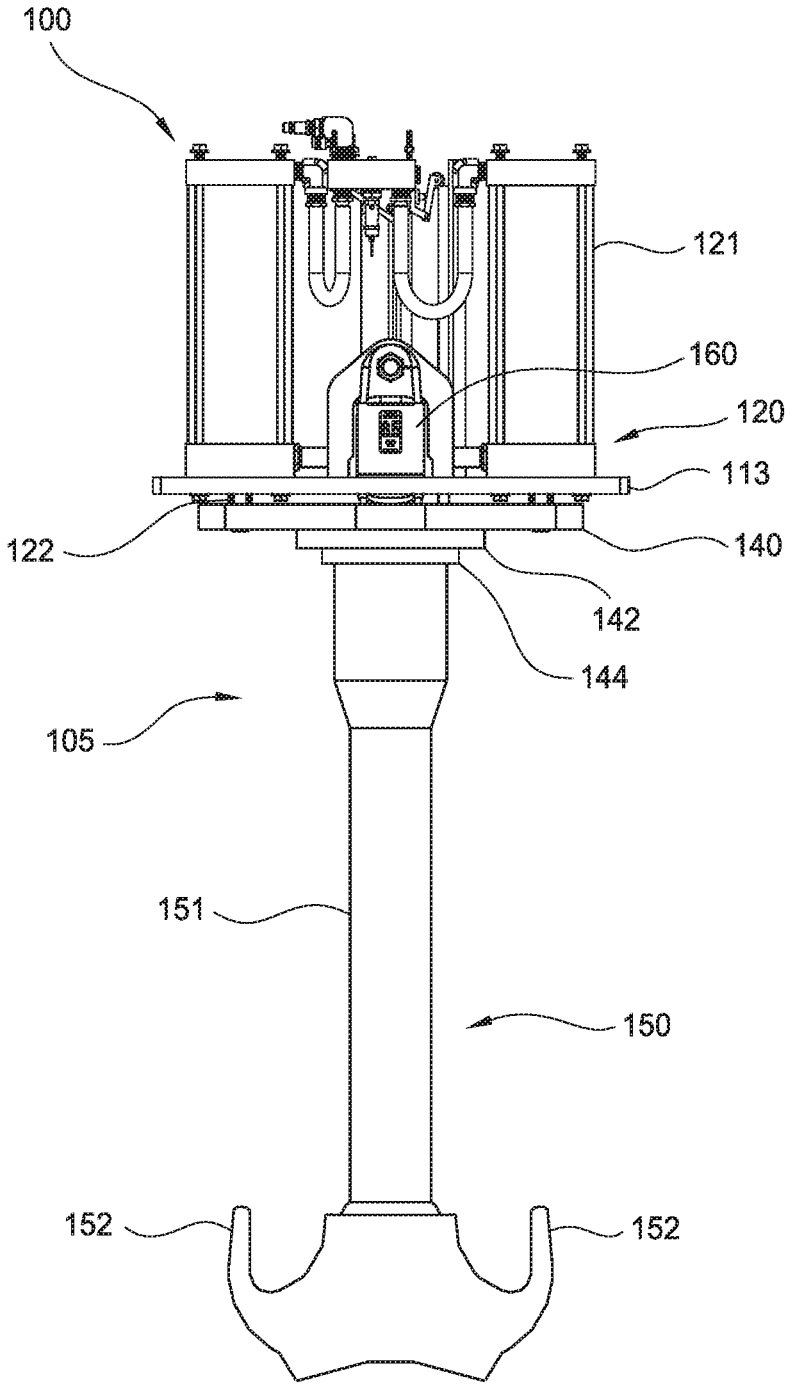
FIG. 3 illustrates the compensator assembly without the sidewalls and the ceiling of the housing.

FIG. 2 illustrates a perspective view of a tubular compensator assembly 105 having the compensator 100 and the lift member 150. The compensator 100 includes a housing 112 having a base 113. FIG. 3 illustrates the compensator 100 without the sidewalls and the ceiling of the housing 112. One or more actuators are disposed on the base 113. In one embodiment, the actuator is a piston and cylinder assembly 120. In this example, two piston and cylinder assemblies 120 are disposed on each side of the center of the base 113. The cylinders 121 are attached to the base 113, and each of the pistons 122 extend through a hole in the base 113. The cylinder assemblies may be actuated using any suitable manner known, including electrics, mechanics, or fluids such as hydraulics and pneumatics.

Figure 4:
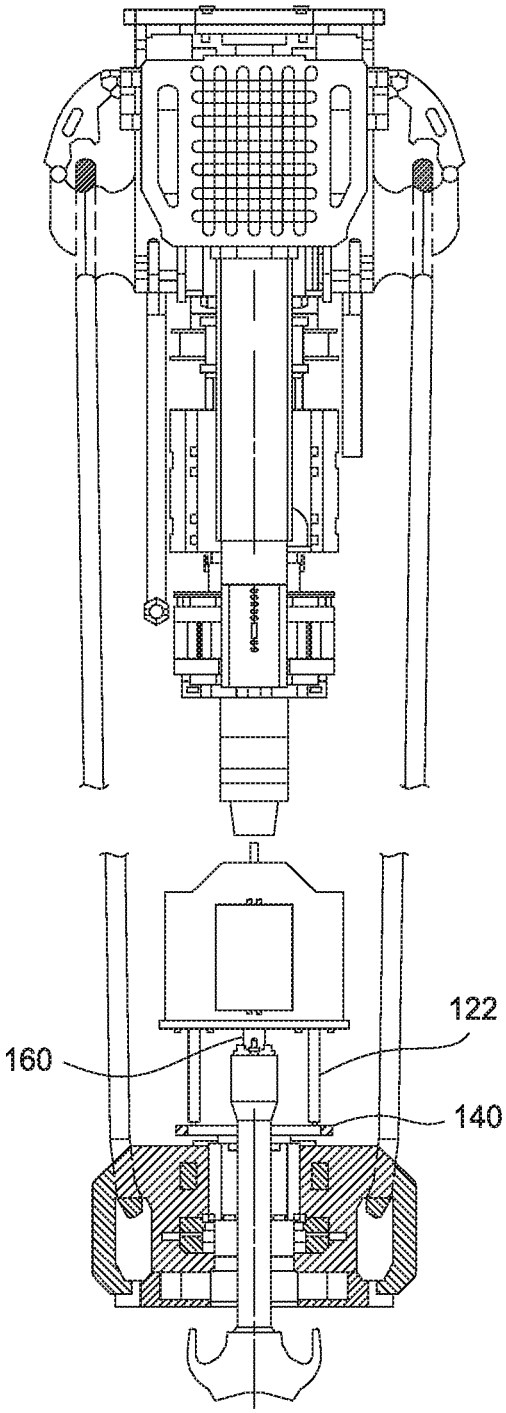
FIG. 4 illustrates the compensator assembly of FIG. 1 in an extended position.

A support member 140 is attached to the lower end of the pistons 122 (see also FIG. 4). In this respect, the base 113 is movable relative to the support member 140 by extending or retracting the pistons 122 from the cylinders 121. The support member 140 includes a hole for accommodating the lift member 150. In use, the support member 140 is disposed on top of the elevator 10. The support member 140 has at least one dimension that is larger than the inner diameter of the bore 17. For example, the support member 140 has a width that is larger than the inner diameter of the bore 17 of the elevator 10 such that the support member 140 can be disposed across the bore 17. In another example, the support member 140 has an outer diameter that is larger than the inner diameter of the bore 17. In one embodiment, an optional spacer member 142 is disposed below the support member 140. The spacer member 142 may be in contact with the elevator 10 instead of the support member 140. The spacer member 142 provides a specified separation distance between the top of the elevator 10 and the support member 140. In another example, the support member 140 is integral with the spacer member 142. In another embodiment, an optional guide member 144 is disposed below the support member 140 or, if used, below the spacer member 142. The guide member 144 is sufficiently sized such that guide member 144 is at least partially disposed in the bore 17 of the elevator 10 when the support member 140 is disposed on the elevator 10. In one example, the guide member 144 has an outer diameter that is less than the inner diameter of the bore 17. The guide member 144 may assist with centering of the compensator 100 relative to the elevator 10 when the compensator 100 is disposed on the elevator 10.

A swivel 160 is used to couple the compensator 100 to the lift member 150. The swivel 160 includes an upper portion attached to the base 113 and a lower portion for connection with the upper end of the lift member 150. In one embodiment, at least a section of the lower portion of the swivel 160 extends through a hole in the base 113. The swivel 160 allows the lift member 150 to rotate relative to the base 113 during a makeup or breakout connection. Any suitable swivel 160 that allows the lift member 150 to rotate relative to the base 113 may be used.

Figure 5:
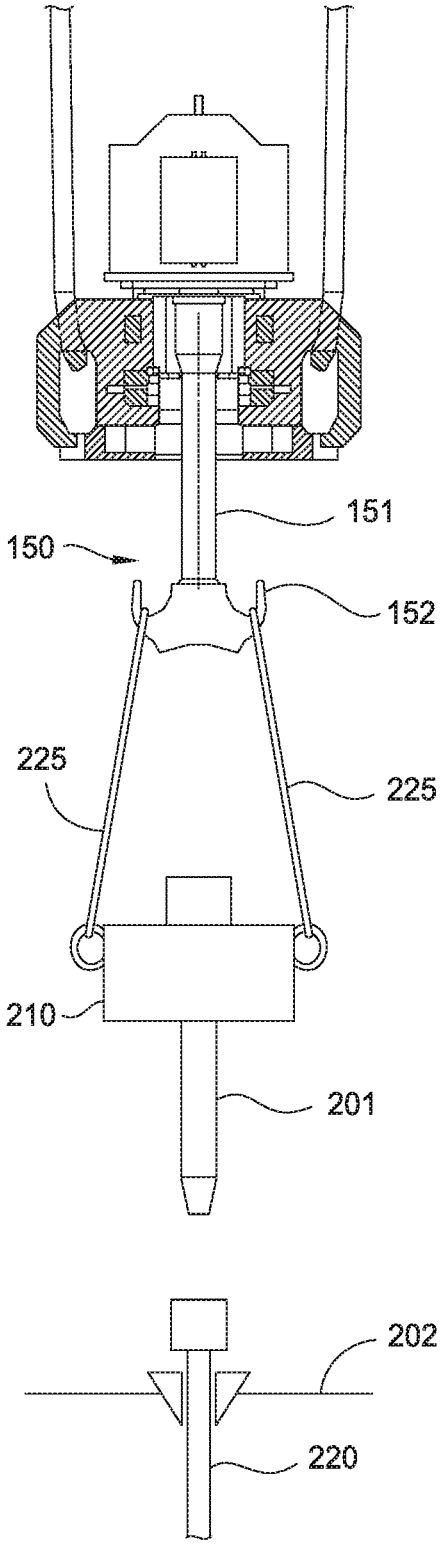
FIG. 5 and FIG. 6 illustrate operation of the compensator assembly of FIG. 1 for tubular makeup.

The lift member 150 includes a shank 151 having an upper end for connection to the swivel 160 and a lower end configured to couple with a second elevator 210 (see FIG. 5). For example, the lower end includes two hooks 152 for coupling with links 225 that are coupled to the second elevator 210. In one example, the lift member 150 is a becket. The second elevator 210 may be configured to move the tubular 201 to be added or removed from a tubular string 220. In one example, the second elevator 210 may be a single joint elevator. In one embodiment, the compensator 100 and the lift member 150 are delivered as separate components to a work site, such as a rig, and coupled together at the work site. In another example, the compensator 100 and the lift member 150 may already be coupled together when delivered to the rig.

In operation, the elevator 10 may be lowered to a rig floor 202 where the compensator 100 and the lift member 150 are positioned. A second elevator 210, such as a single joint elevator, may be coupled to the lift member 150 using two links 225. Each link 225 is coupled to a hook 152 of the lift member 150. The elevator 10 opens its doors to receive the shank 151 of the lift member 150 in the bore 17 of the elevator 10. In one example, the compensator 100 and the lift member 150 are positioned in an upright position to facilitate entry into the elevator 10. In another example, the compensator 100 and the lift member 150 are positioned at an angle from 45 degrees to 90 degrees relative to the rig floor. After closing the elevator's 10 doors, the elevator 10 is hoisted in the rig, along with the compensator 100, the lift member 150, and the second elevator 210.

In this example, installation of the compensator 100 only requires disposing the shank of the lift member 150 in the elevator 10 and resting the compensator 100 on top of the elevator 10. Installation of the compensator 100 does not require attaching the compensator 100 to other components of the rig. As a result, the compensator 100 may be considered a modular tool that can be quickly installed on most elevators available at the work site.

FIG. 1 shows the compensator 100 resting on top of the elevator 10. The elevator 10 in turn is supported by bails 25, which are coupled to the top drive 20. In this example, a spacer member 142 and a guide member 144 are used with the compensator 100. The guide member 144 is at least partially disposed in the bore 17 to help center the compensator 100 relative to the bore 17. The spacer member 142 is in contact with the elevator 10 while providing a gap between the support member 140 and the elevator 10. Because the compensator 100 is resting on top of the elevator 10, the load from the lift member 150 is transferred to the elevator 10. The load path includes at least from the lift member 150, to the swivel 160, to the base 113, to the piston and cylinder assemblies 120, to the support member 140, to the spacer member 142, and then to the elevator 10.

Figure 6:
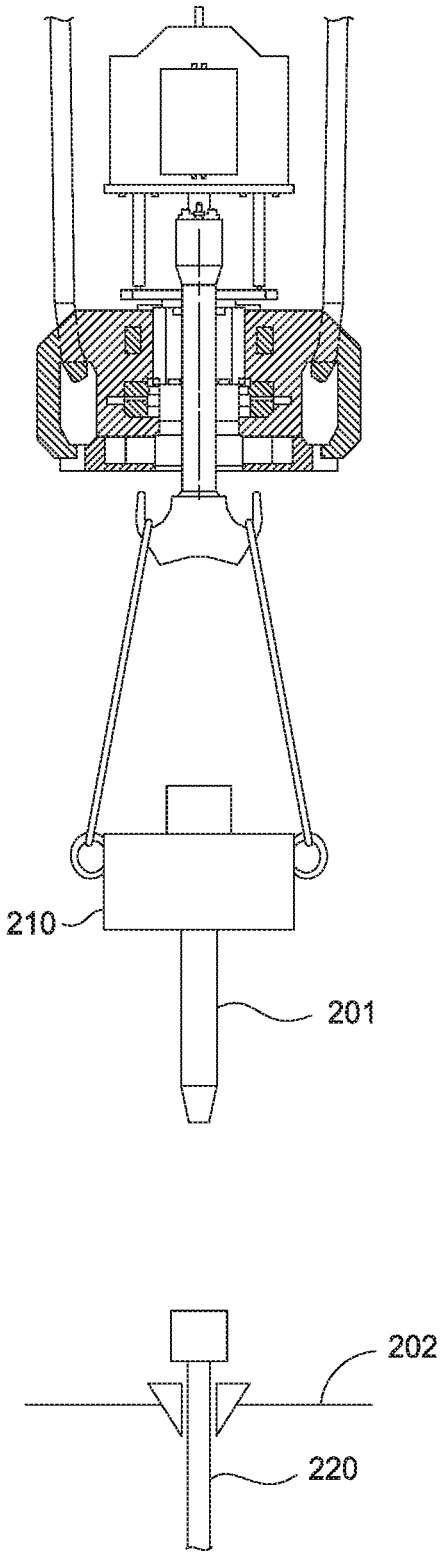

After a tubular 201 to be added to a tubular string 220 is inserted into the single joint elevator 210, the tubular 201 is moved into position above the tubular string 220, as shown in FIG. 5. Before makeup, the compensator 100 is operated to compensate for the weight of the tubular 201. In one embodiment, pneumatic fluid is supplied to the piston and cylinder assemblies 120 to extend the piston 122 out of the cylinder 121, as seen in FIG. 4. In this respect, the housing 112 is raised relative to the support member 140 and the elevator 10. In turn, the lift member 150 is also raised relative to the support member 140 and the elevator 10. In this position, load on the lift member 150 is still transferred to elevator 10. Thus, the load from the lift member 150 is always transferred to the elevator 10 when the housing 112 is in either the extended position, shown in FIG. 4, or the retracted position, shown in FIG. 1. FIG. 6 shows the tubular 201 raised by the compensator 100 as a result of actuating the compensator 100.

During makeup, the piston and cylinder assemblies 120 will retract in response to the threading of the tubular 201 to the tubular string 220. As a result, the housing 112 is lowered relative to the support member 140. The housing 112 will continue to lower in response to the threading until the completion of the makeup. The lift member 150 may rotate relative to the housing 112 during makeup. After makeup, the housing 112 may return to the retracted position of FIG. 1.

To remove the compensator 100 and the lift member 150, the elevator 10 is lowered to the rig floor 202, and the doors are opened. The compensator 100 and the lift member 150 are moved out of the elevator 10. In this example, no other disconnections from components suspended from the top drive or rig are required to be made.

In one embodiment, a tubular compensator assembly includes a housing; a lift member coupled to the housing; a support member; and an actuator for moving the housing and the lift member relative to the support member.

In one or more of the embodiments described herein, the lift member extends through the support member.

In one or more of the embodiments described herein, the actuator comprises a piston and cylinder assembly.

In one or more of the embodiments described herein, the support member is attached to the distal end of a piston of the piston and cylinder assembly.

In one or more of the embodiments described herein, a swivel is connected between the housing and the lift member.

In one or more of the embodiments described herein, the lift member is rotatable relative to the housing.

In one or more of the embodiments described herein, a spacer member is disposed below the support member.

In one or more of the embodiments described herein, a guide member is coupled to the support member.

In another embodiment, a tubular handling assembly includes an elevator and a tubular compensator assembly. The tubular compensator assembly includes a housing; a lift member coupled to the housing; a support member; and an actuator for moving the housing and the lift member relative to the support member and the elevator.

In one or more of the embodiments described herein, the housing has an extended position and a retracted position.

In one or more of the embodiments described herein, a load from the lift member is transferred to the elevator when the housing is in the extended position.

In one or more of the embodiments described herein, a guide member coupled to the support member.

In one or more of the embodiments described herein, a swivel is connected between the housing and the lift member.

In one or more of the embodiments described herein, the support member is in contact with the elevator.

In one or more of the embodiments described herein, the support member is in contact with the elevator at both the extended position and the retracted position of the housing.

In one or more of the embodiments described herein, a spacer member is disposed below the support member, wherein the spacer member is in contact with the elevator.

In one or more of the embodiments described herein, a guide member is coupled to the support member, wherein the guide member is at least partially disposed in the elevator.

In another embodiment, a method of connecting a first tubular to a second tubular includes supporting the first tubular using a compensator; transferring a weight of the first tubular to an elevator; actuating the compensator to lift the first tubular relative to the elevator while maintaining the weight on the elevator; and rotating the first tubular relative to the second tubular for connection.

In one or more of the embodiments described herein, actuating the compensator extends a housing away from a support member of the compensator.

In one or more of the embodiments described herein, the support member is in contact with the elevator.

In one or more of the embodiments described herein, rotating the first tubular relative to the second tubular retracts the housing relative to the support member.

In one or more of the embodiments described herein, rotating the first tubular comprises rotating the first tubular relative to the elevator.

While the foregoing is directed to embodiments of the present disclosure, other and further embodiments of the disclosure may be devised without departing from the basic scope thereof, and the scope thereof is determined by the claims that follow.

The invention claimed is:

1. A method of connecting a first tubular to a second tubular, comprising:

supporting the first tubular using a first elevator;

supporting the first elevator using a lift member;

supporting the lift member using a compensator;

supporting the compensator using a second elevator;

actuating the compensator to lift the lift member relative to the second elevator, wherein the actuating the compensator extends a housing away from a support member of the compensator; and rotating the first tubular relative to the second tubular for connection, wherein the rotating the first tubular relative to the second tubular retracts the housing relative to the support member.

2. The method of claim 1, wherein the support member is positioned on top of the second elevator.

3. The method of claim 1, wherein rotating the first tubular comprises rotating the first tubular relative to the second elevator.

4. The method of claim 1, wherein weight is maintained on the second elevator while rotating the first tubular relative to the second tubular.

* * * * *